US007111616B2

(12) United States Patent
Oyamada et al.

(10) Patent No.: US 7,111,616 B2
(45) Date of Patent: Sep. 26, 2006

(54) STARTING APPARATUS OF DIAPHRAGM-TYPE CARBURETOR

(75) Inventors: Koken Oyamada, Iwate-ken (JP); Mamoru Toda, Iwate-ken (JP)

(73) Assignee: Zama Japan Co., Ltd., Iwate-ken (JP)

( * ) Notice: Subject to any disclaimer, the term of this patent is extended or adjusted under 35 U.S.C. 154(b) by 0 days.

(21) Appl. No.: 10/992,787

(22) Filed: Nov. 22, 2004

(65) Prior Publication Data

US 2005/0109303 A1 May 26, 2005

(30) Foreign Application Priority Data

Nov. 25, 2003 (JP) ..... 2003-393516

(51) Int. Cl.
*F02M 37/16* (2006.01)

(52) U.S. Cl. ..... 123/516; 261/35

(58) Field of Classification Search ..... None
See application file for complete search history.

(56) References Cited

U.S. PATENT DOCUMENTS 4,271,093 A * 6/1981 Kobayashi ..... 261/34.1
5,554,322 A * 9/1996 Kobayashi ..... 261/35
6,481,403 B1 * 11/2002 Ashcraft et al. ..... 123/179.11

* cited by examiner

*Primary Examiner*—Andrew M. Dolinar
(74) *Attorney, Agent, or Firm*—Baker Botts L.L.P.

(57) ABSTRACT

A starting apparatus of a diaphragm-type carburetor, a starting pump disposed at a convenient and accessible location which is separate from a carburetor main body, and air is prevented from being mixed into fuel, in such a structure constructed as a suction-type starting pump. A suction passage extends from a fuel metering chamber and extends beyond an outer portion of the carburetor main body. A starting pump conveniently disposed is separate from the carburetor, and an inlet check valve of the starting pump is disposed in the carburetor main body so as to reduce a volumetric capacity of a section extending to the inlet check valve from the fuel metering chamber, thereby preventing the air from remaining within the suction passage.

3 Claims, 4 Drawing Sheets

STARTING APPARATUS OF DIAPHRAGM-TYPE CARBURETOR

BACKGROUND OF THE INVENTION

This application claims the benefit of Japanese Patent Application No. 2003-393516, filed Nov. 25, 2003.

1. Field of the Invention

The present invention relates to an apparatus for supplying a starting fuel to a fuel metering chamber of a carburetor before starting an engine.

2. Description of Related Art

A diaphragm-type carburetor may be employed as a fuel supply means of a general-purpose, internal combustion engine used as a power source of a portable working machine, such as a machine for use in agriculture, forestry, or the like. The supplying of fuel to an operating engine may be carried out as follows. The fuel is drawn from a fuel tank to a fuel pump by a negative pressure of a pulse pressure generated in a crank case or the like and is supplied to a fuel metering chamber by a positive pressure. The fuel then may be delivered to an intake passage via an idle port, a slow port, and a main nozzle, and is mixed with air to be supplied to the engine.

However, when there is little or no fuel in the fuel metering chamber when the engine starts, it may be desirable to supply fuel to the fuel metering chamber, so that the chamber may be filled prior to engine start, and it also may be desirable to supply extra fuel in order to improve the engine's low temperature starting properties at a cold start time. A starting pump may be provided for this purpose, and the engine may be smoothly started by manually operating the starting pump so as to supply fuel into the fuel metering chamber.

Such starting pumps include at least two kinds: a pressure-type structure (e.g., Japanese Unexamined Utility Model Publication No. 47-38218 and Japanese Unexamined Patent Publication No. 56-6049) and a suction-type structure (e.g., Japanese Unexamined Patent Publication No. 55-69748, Japanese Patent Publication No. 57-59417 and Japanese Unexamined Patent Publication No. 5-164001). The pressure-type structure may include a dome-shaped pump body portion generally formed from an elastic material, an inlet check valve placed in an inlet of a pump chamber in an inner portion of the pump body, and an outlet check valve placed in an outlet, and may have a fuel tank, a starting pump, a fuel pump, and a fuel metering chamber arranged in that order, for delivering fuel stored in the fuel pump to the fuel metering chamber via the starting pump. The suction-type structure may include a fuel tank, a fuel pump, a fuel metering chamber, and a starting pump arranged in that order for drawing air by the starting pump, for generating a negative pressure in the fuel metering chamber, and for feeding fuel from the fuel tank by the negative pressure. These structures may be properly selected depending upon the layout of the machine when the carburetor is mounted to the engine.

In the pressure-type starting pump described in the Japanese Unexamined Patent Publication No. 56-6049, the starting pump is placed in the middle of the fuel pipe passage which passage extends from the fuel tank to the fuel pump and is separated from the carburetor. In the suction-type starting pump described in Japanese Unexamined Patent Publication No. 55-69748, Japanese Patent Publication No. 57-59417 and Japanese Unexamined Patent Publication No. 5-164001, the suction passage which extends from the fuel metering chamber to an exterior portion of the carburetor, may be extended to place the starting pump in the suction passage in a location separate from the carburetor. In accordance with this structure, several alternatives exist for placing the starting pump in a readily operable location.

Nevertheless, when the suction-type starting pump is placed apart from the carburetor so as to be readily operable, a large space for storing air is formed within the suction passage between the fuel metering chamber and the inlet check valve installed in the starting pump. The air remaining within the suction passage during the engine operation flows into the fuel metering chamber and then is delivered to the intake passage from the fuel metering chamber together with the fuel, whereby a diluted air-fuel mixture is produced. Alternatively, the fuel may be delivered in a large quantity by a pumping effect caused by the residual air and an excessively dense, air-fuel mixture is produced, so that there is a risk that a malfunction of the engine may occur and a deterioration of exhaust gas may occur.

SUMMARY OF THE INVENTION

The present invention solves the problem described above. An object of the present invention is to provide a starting apparatus for a diaphragm-type carburetor arranged at a convenient position for installation and access while preventing residual air from flowing into a fuel metering chamber and generating a pumping effect. It is a feature of the present invention that its structure is similar to suction-type starting pump which is placed in a suction passage extending from the fuel metering chamber.

The present invention minimizes a volumetric capacity of the suction passage extending to an inlet check valve from the fuel metering chamber and prevents air from remaining with the passage and thereby preventing an air-fuel mixture supplied to an engine from being diluted or excessively enriched. The suction-type starting pump is part of the diaphragm-type carburetor and is positioned at a location which is separate or distal from the carburetor so as to make it convenient and accessible. The inlet check valve is disposed in the carburetor main body or proximate to the carburetor main body in the suction passage.

A portion of the suction passage extending to the inlet check valve from the fuel tank via the fuel metering chamber experiences a negative pressure due to the operator's repeated pressing and releasing of the pump body of the starting pump, and fuel in the fuel tank is drawn into the fuel metering chamber and filling it. At this time, fuel also is drawn into the portion extending to the inlet check valve from the fuel metering chamber of the suction passage without increasing the operating pressure of the starting pump, little or no residual air remains in this portion. Accordingly, the air-fuel mixture may not be diluted or excessively enriched by the residual air during engine operation. Further, because the length of the extended portion beyond the external portion of the carburetor in the suction passage and the disposition of the starting pump may be optimally selected, it is possible to place the starting pump at a convenient and accessible position.

Further, the present invention may be configured, such that the starting pump disposed separate or distal from the carburetor in accordance with the invention described above. The starting pump comprises a first inlet check valve and an outlet check valve, and the first inlet check valve installed in the carburetor main body in accordance with the invention described above further comprises a second inlet check valve, thereby preventing the efficiency of the starting pump from being reduced even if the portion of the suction passage from the carburetor to the starting pump lengthens and has a larger volume in addition to preventing the air from remaining in the passage.

Because the inlet check valve of the starting pump is closed when the pump body is pressed, only air in the inner portion of the pump body is compressed and discharged from the outlet check valve, and air in the suction passage portion extending to the starting pump from the inlet check valve installed in the carburetor main body or proximate to the carburetor main body in the suction passage is not compressed. Accordingly, the original efficiency is maintained, and starting fuel may be supplied without increasing the operating pressure of the starting pump.

As described above, in accordance with the present invention, because the starting pump is disposed separate or distal from the carburetor, the starting pump's location may be convenient and accessible, and air may be prevented from remaining between the fuel metering chamber and the inlet check valve, so that it is possible to carry out an improved operation of the engine without causing engine malfunction or exhaust gas deterioration. Further, even if the portion of the suction passage from the carburetor to the starting pump lengthens and has a larger volume, the efficiency of the starting pump is not reduced, and starting fuel may be supplied by a general operating pressure from the starting pump.

Other objects, features, and advantages will be apparent to those of ordinary skill in the relevant art in view of the following detailed description of preferred embodiments and the accompanying drawings.

DETAILED DESCRIPTION OF PREFERRED EMBODIMENTS

A description is provided of embodiments in accordance with the present invention with reference to the accompanying drawings.

Figure 1A:
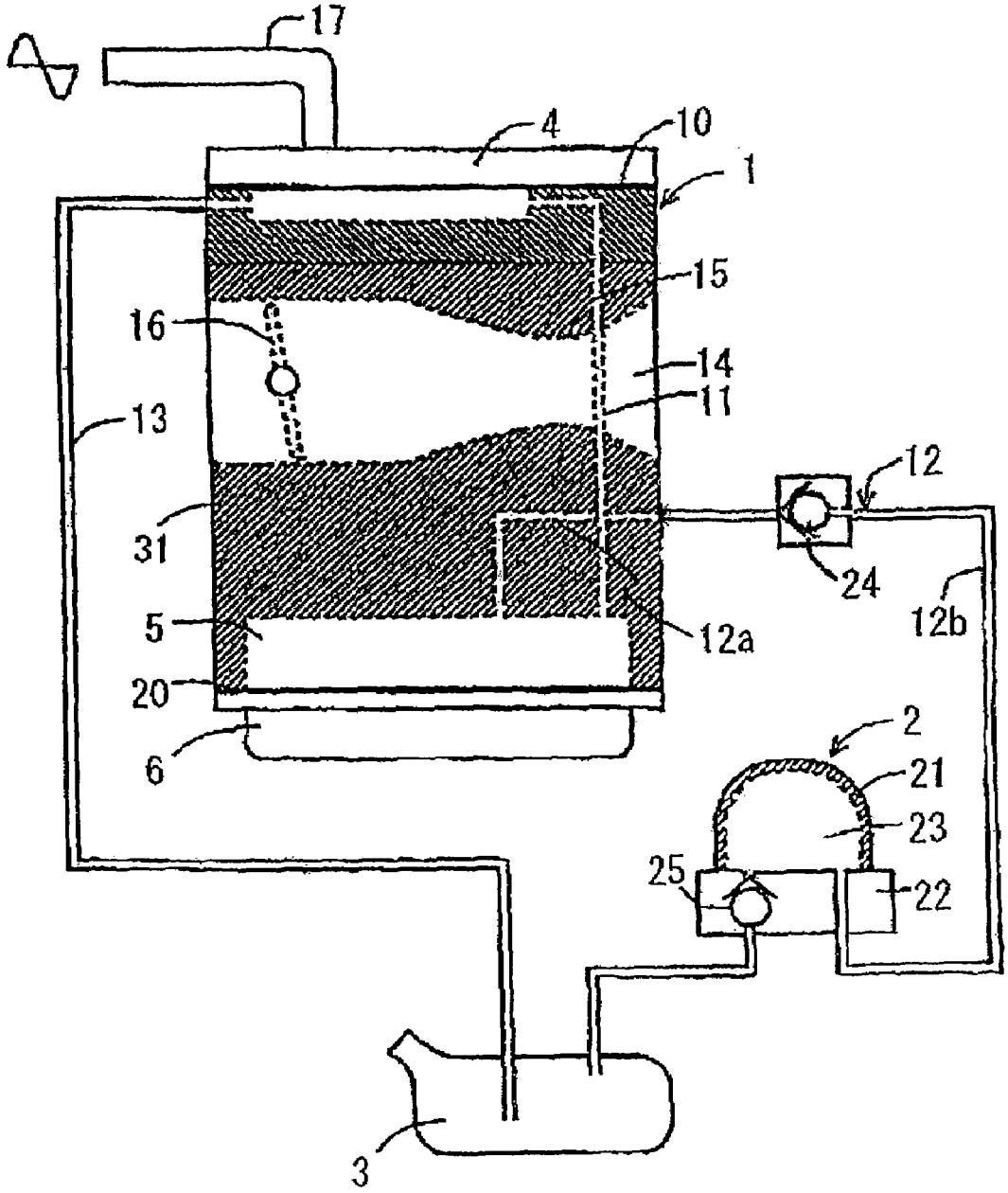
FIG. 1A is a vertical, cross-sectional view showing an embodiment in accordance with the present invention, in which an inlet check valve is disposed proximate to the main carburetor body.
Figure 1B:
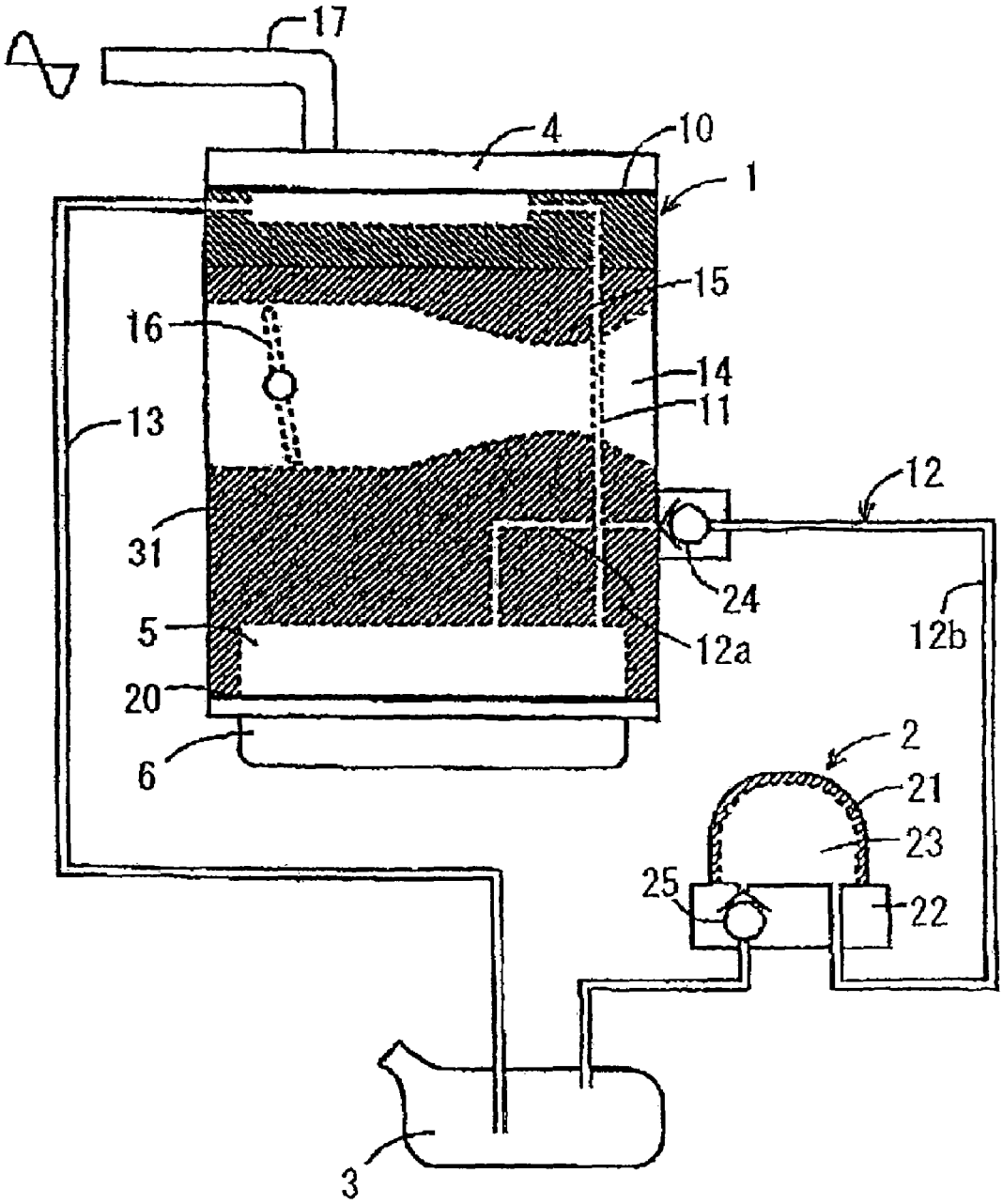
FIG. 1B is a vertical, cross-sectional view showing the embodiment in accordance with the present invention, in which an inlet check valve is disposed in the main carburetor body.

FIGS. 1A and 1B are schematic views of arrangements of a diaphragm-type carburetor 1 and a starting pump 2 in accordance with the present invention. Diaphragm-type carburetor 1 has a horizontal intake passage 14 provided with a venturi tube 15 and a throttle valve 16 in a carburetor main body 31. A fuel pump 4 is provided in an upper or first surface of the carburetor main body 31. A fuel metering chamber 5 is provided in a lower or second surface thereof, and the starting pump 2 is installed in a location which is separate or distal from the diaphragm carburetor 1 in a suction passage 12 extending from fuel metering chamber 5.

Fuel pump 4 may be a known pulsation-type diaphragm pump and introduces a pulse pressure generated in a crank chamber of an engine from a pulse pressure introduction pipe 17 so as to pulsate diaphragm 10. Consequently, fuel is drawn from fuel tank 3 through a fuel introduction pipe 13, and fuel is delivered to fuel metering chamber 5 via a fuel passage 11.

Fuel metering chamber 5 is separated from an atmospheric air chamber 6 by a diaphragm 20 and holds a predetermined amount of fuel. The fuel is delivered to an outside portion of throttle valve 16 and a narrowest portion of venturi tube 15 by an idle port, a slow port, and a main nozzle, which are not illustrated, and is mixed with air flowing through intake passage 14 so as to be supplied to the engine.

Starting pump 2 comprises a pump chamber 23 surrounded by a dome-shaped pump body 21 made of an elastic material and a pump base table 22, is installed in a distal portion of a suction passage 12 which extends from an upper portion of fuel metering chamber 5, is extends beyond an outer portion of carburetor main body 31, and is connected to the fuel tank 3. An inlet check valve 24 of starting pump 2 is installed in carburetor main body 31 or proximate to carburetor main body 31 in suction passage 12, and an outlet check valve 25 is provided in pump base table 22.

Because inlet check valve 24 is installed in carburetor main body 31 or proximate to carburetor main body 31 in suction passage 12 near fuel metering chamber 5, a volumetric capacity of a section 12*a* of suction passage 12 from fuel metering chamber 5 to inlet check valve 24 is reduced. In this case, inlet check valve 24 may be built in carburetor main body 31 instead of on a surface of carburetor main body 31.

Inlet check valve 24 of starting pump 2, is illustrated by a ball-shaped valve. Nevertheless, the starting apparatus may employ a variety of valve shapes, such as a flap shape, a flat plate shape, a duck bill shape, and the like.

When starting the engine in a state in which little or no fuel is in fuel metering chamber 5, fuel is supplied to fuel metering chamber 5 from fuel tank 3 by repeating the pressing and releasing motion of pump body 21 of starting pump 2. At this time, fuel is filled in section 12*a* extending to inlet check valve 24 from fuel metering chamber 5 due to the general operating pressure generated by starting pump 2, and an amount of air remaining in suction passage 12 is reduced or eliminated. If a sufficient amount of fuel for starting the engine is supplied to fuel metering chamber 5, the pressing and releasing motion of starting pump 2 is stopped, and the engine is started.

If the operation of starting pump 2 is stopped, inlet check valve 24 is closed, and residual air is drawn into fuel metering chamber 5 and delivered to intake passage 14 together with fuel, or if a pumping effect is generated, the amount of residual air is reduced, so that neither engine malfunction nor exhaust gas deterioration occurs.

Further, it is possible to readily lengthen the extended portion of suction passage 12 so as to arrange starting pump 2 at a convenient and accessible location.

In addition, suction passage 12 may be open to atmospheric air in an outlet side of outlet check valve 25. Nevertheless, when suction passage 12 is connected to fuel tank 3, the fuel flowing into suction passage 12 and the fuel vapor generated therein may be recovered in fuel tank 3 without being discharged to the atmosphere, and, thus, it is possible to better protect the environment.

Moreover, when a section 12*b* extending to starting pump 2 from inlet check valve 24 of suction passage 12 is lengthened, a substantial volumetric capacity of air in section 12*b* is compressed when pressing the pump body 21 in accordance with the embodiment described above, so that an amount of air discharged from pump chamber 23 through outlet check valve 25 is reduced. In addition, because the compressed air in section 12*b* first flows into pump chamber 23 when an operator releases pump body 21, an amount of air drawn from carburetor 1 is reduced, whereby the pump efficiency is lowered, and it may be necessary to widely increase the operating pressure.

Figure 2A:
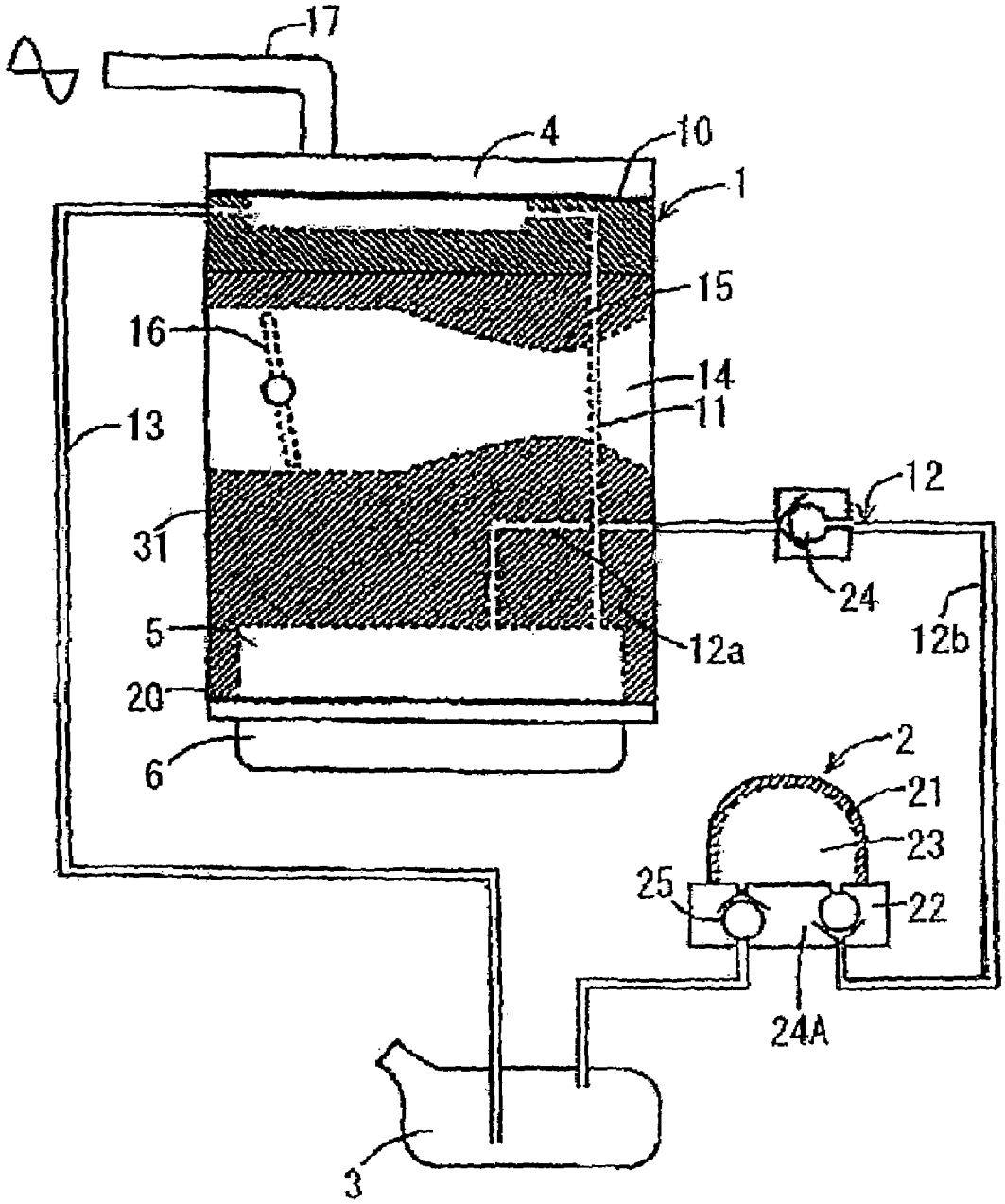
FIG. 2A is a vertical, cross-sectional view showing a different embodiment in accordance with the present invention, in which an inlet check valve is disposed proximate to the main carburetor body.
Figure 2B:
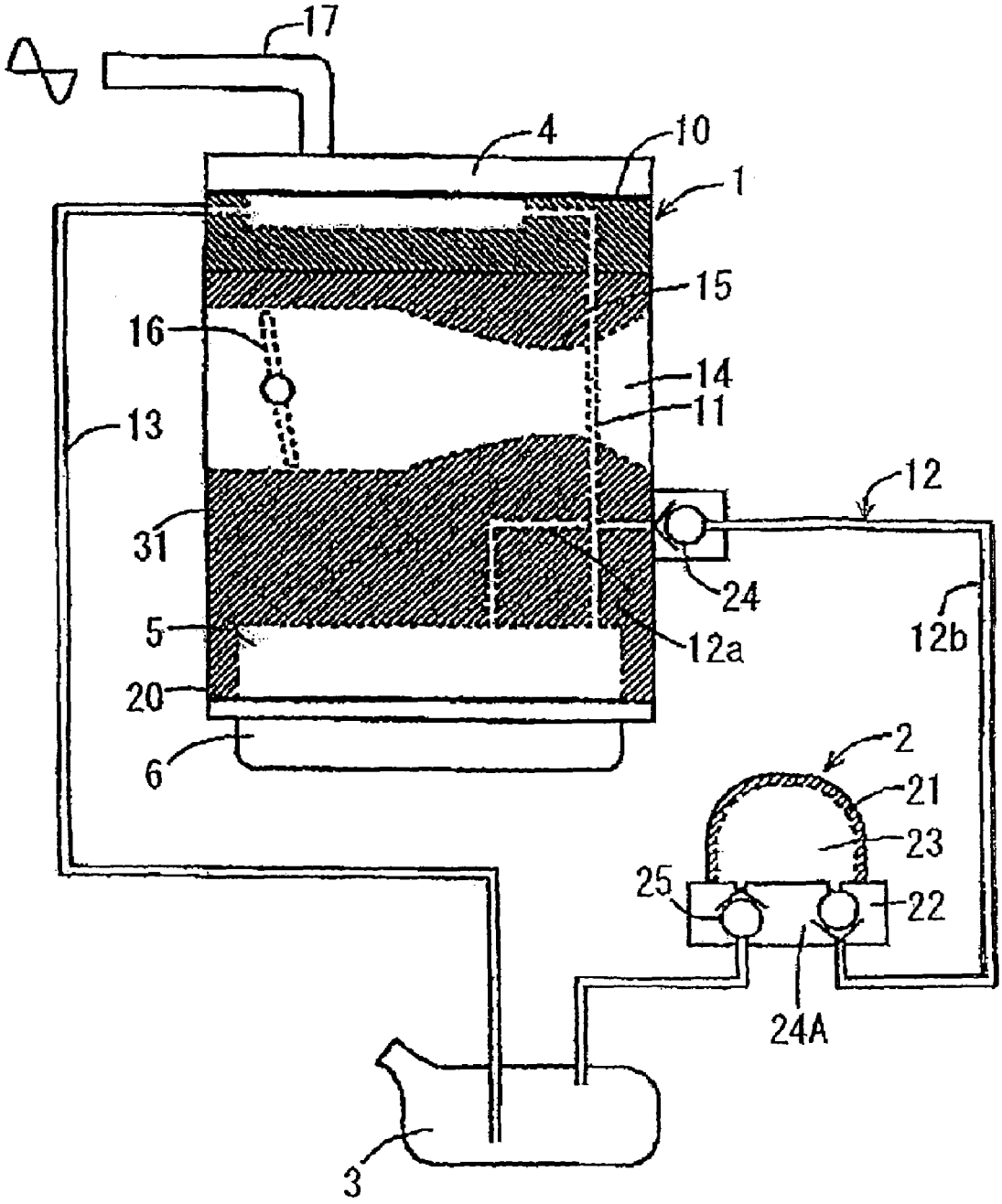
FIG. 2B is a vertical, cross-sectional view showing the different embodiment in accordance with the present invention, in which an inlet check valve is disposed in the main carburetor body.

FIGS. 2A and 2B show embodiments in which section 12*b* of suction passage 12 extending to starting pump 2 from inlet check valve 24 is lengthened. Starting pump 21 is structured similarly to known pumps in which the inlet check valve is installed in a position shown by reference symbol 24A, and the inlet check valve and outlet check valve 25 are installed, and inlet check valve 24 installed in the carburetor main body 31 is provided as an additional inlet check valve.

When an operator presses pump body 21, inlet check valve installed in the position shown by reference symbol 24A is closed, thereby compressing the air in the pump chamber 24 without compressing air in section 12*b* so as to discharge the air from outlet check valve 24. When an operator releases pump body 21, two inlet check valves are simultaneously opened and draw air from the side of carburetor 1 into pump chamber 23 following the air which is not compressed in section 12*b*. Accordingly, starting pump 2 may maintain the original pump effect and may supply the starting fuel to fuel metering chamber 5 without increasing the operating pressure even if section 12*b* is lengthened.

Although preferred embodiments of the present invention have been described in detail herein, the scope of the invention is not limited thereto. It will be appreciated by those of ordinary skill in the relevant art that various modifications may be made without departing from the scope of the invention. Accordingly, the embodiments disclosed herein are only exemplary. It is to be understood that the scope of the invention is not to be limited thereby, but is to be determined by the claims which follow.

What is claimed is:

1. A starting apparatus of a diaphragm-type carburetor, comprising a starting pump which is disposed in a suction passage and extending from a fuel metering chamber, wherein said suction passage extends beyond said carburetor main body, said starting pump is disposed, such that said pump is separate from said carburetor main body and comprises a first inlet check valve and an outlet check valve, and a second inlet cheek valve is disposed proximate to said carburetor main body in said suction passage.

2. The starting apparatus of a diaphragm-type carburetor of claim 1, wherein said suction passage is connected to a fuel tank via said starting pump.

3. The starting apparatus of claim 1, wherein said second inlet check valve of said starting pump is disposed in said carburetor main body.

* * * * *